US007243866B2

(12) United States Patent
Stehr et al.

(10) Patent No.: US 7,243,866 B2
(45) Date of Patent: Jul. 17, 2007

(54) AGITATOR MILL

(75) Inventors: Norbert Stehr, Grünstadt (DE); Philipp Schmitt, Lampertheim (DE)

(73) Assignee: Bühler AG, Uzwil (CH)

( * ) Notice: Subject to any disclaimer, the term of this patent is extended or adjusted under 35 U.S.C. 154(b) by 195 days.

(21) Appl. No.: 11/169,921

(22) Filed: Jun. 30, 2005

(65) Prior Publication Data

US 2006/0261199 A1 Nov. 23, 2006

(30) Foreign Application Priority Data

May 19, 2005 (EP) ..... 05010814

(51) Int. Cl.
*B02C 17/16* (2006.01)

(52) U.S. Cl. ..... 241/65; 241/171; 241/172

(58) Field of Classification Search ..... 241/171, 241/172, 65

See application file for complete search history.

(56) References Cited

U.S. PATENT DOCUMENTS 5,996,914 A * 12/1999 Stehr ..... 241/171

FOREIGN PATENT DOCUMENTS

DE 41 42 213 A1 6/1993

* cited by examiner

*Primary Examiner*—Mark Rosenbaum
(74) *Attorney, Agent, or Firm*—Browdy and Neimark, PLLC

(57) ABSTRACT

An agitator mill comprises an annular cylindrical exterior grinding chamber which is defined by an inner wall of a grinding receptacle and an outer wall of a rotor; and an interior grinding chamber which is defined by an inner wall of the rotor and an outer casing of an interior stator. The grinding chambers are interconnected by a deflection chamber. A grinding-stock supply area, which is upstream of the exterior grinding chamber, and a separator device, which is disposed approximately on the same side of the grinding receptacle, serving for grinding-stock discharge, are interconnected by auxiliary-grinding-body return conduits. These conduits are arranged in an independent auxiliary-grinding-body return module and are open towards a front of the module.

12 Claims, 12 Drawing Sheets

AGITATOR MILL

BACKGROUND OF THE INVENTION

1. Field of the Invention

The invention relates to an agitator mill for treating free-flowing grinding stock, comprising a grinding receptacle which defines a substantially closed grinding chamber by means of an inner wall; and an agitator which is rotarily drivably disposed therein and which is cup-shaped in relation to a common central longitudinal axis, having an annular cylindrical rotor which has a closed wall; and an interior stator which is disposed within the rotor and fixedly joined to the grinding receptacle; wherein an annular cylindrical exterior grinding chamber is formed between the inner wall of the grinding receptacle and an outer wall of the rotor; and an annular cylindrical interior grinding chamber is formed between an inner wall of the rotor and an outer casing of the interior stator, the interior grinding chamber being arranged coaxially within the exterior grinding chamber and connected thereto via a deflection chamber; wherein the exterior grinding chamber, the deflection chamber and the interior grinding chamber constitute the grinding chamber which is partially filled with auxiliary grinding bodies; wherein a grinding-stock supply area, which is disposed upstream of the exterior grinding chamber and opens into it in the direction of flow of the grinding stock, and a separator device, which is disposed downstream of the interior grinding chamber in the direction of flow, are disposed approximately on the same side of the grinding receptacle for the grinding stock to pass through; wherein auxiliary-grinding-body return conduits are provided in the agitator in an independent auxiliary-grinding-body return module, returning the auxiliary grinding bodies from the vicinity of the separator device into the grinding-stock supply area, the return conduits connecting the end of the interior grinding chamber to the beginning of the exterior grinding chamber; and wherein the inner wall of the grinding receptacle and the outer wall and the inner wall of the rotor are free of interruptions.

2. Background Art

In an agitator mill of the generic type known from DE 41 42 213 A1, the auxiliary-grinding-body return conduits are provided within a stepped annular section which can be formed in one piece together with the rotor bottom, but can also be mounted thereon by screwing. The auxiliary-grinding-body return conduits are straight, having a constant width throughout their length from the inlet to the outlet. Seen from inside outwards, they are set counter to the direction of rotation of the rotor. So as to achieve that the auxiliary grinding bodies are catapulted into the auxiliary-grinding-body return conduits, the separator device is made rotatable. It is further provided with entrainer elements which stand out radially and are intended to catapult, outwards into the auxiliary-grinding-body return conduits, the auxiliary grinding bodies which arrive along with the grinding stock, coming from the interior grinding chamber. This is meant to accomplish that grinding-stock particles that have not been ground do not take a short-cut from the exterior grinding chamber through the auxiliary-grinding-body return conduits towards the separator device. That kind of grinding-stock shooting flows lead to a very rough and thus undesired distribution in particle size of the grinding stock. The described purpose requires considerable constructional implementation in the known agitator mill.

SUMMARY OF THE INVENTION

It is an object of the invention to embody an agitator mill of the generic type in such a way that a fine distribution in particle size of the grinding stock can be obtained by constructionally simple means for major as well as minor grinding-stock throughputs.

According to the invention, this object is attained by the features wherein the auxiliary-grinding-body return conduits are open towards a front of the auxiliary-grinding-body return module; and wherein the auxiliary-grinding-body return conduits are curved from the inlet towards the outlet; and/or wherein the auxiliary-grinding-body return conduits have a height e and the grinding-stock/auxiliary-grinding-body separator device has a height, each in the direction of the central longitudinal axis, with $e \leqq 0.8$ f applying to the height e in relation to the height f. The measures according to the invention help accomplish optimization of the overall design of the auxiliary-grinding-body return conduits provided in the auxiliary-grinding-body return module that constitutes an independent component part. The design of the conduits can be implemented in a simple way, because the conduits are open towards a front. The design of the auxiliary-grinding-body return module enables the cross-sectional shape, and in particular the axial extension, of the auxiliary-grinding-body return conduits to be optimized and thus fitted to concrete applications. In particular when only comparatively small throughputs i.e., small quantities per time unit, are to be treated in the agitator mill, the height of the auxiliary-grinding-body return conduits can be reduced in relation to the height of the separator device, as a result of which the risk of grinding-stock shooting flows is restricted. In such a case the auxiliary-grinding-stock return channels may also be straight. Minor throughputs of that kind are found in particular in so-called single-pass operation, with the grinding stock only once passing through the mill at a corresponding sojourn time therein. However, in the case of major through-puts, the auxiliary-grinding-body return conduits must have a correspondingly increased cross section which is attained by a comparatively important height in the axial direction in relation to the height of the separator device. In this case, so as to avoid any auxiliary-grinding-body shooting flows, it is advantageous that the auxiliary-grinding-body return conduits are curved. Major grinding-stock throughputs of that kind are found for instance in circulatory operation, with the grinding stock being repeatedly run through the agitator mill. Moreover, those major throughputs are found when the grinding-stock particle size distribution must comply with strong requirements, there being however no need for super fine grinding.

With inferior throughputs, the embodiment according to which $e<0.5$ f applies to the height e of the auxiliary-grinding-body conduits in relation to the height f of the grinding-stock/auxiliary-grinding-body separator device offers some advantages.

The further development according to which the auxiliary-grinding-body return conduits have an inlet of a width c and an outlet of a width d; and according to which $d>c$ applies to the width c of the inlet in relation to the width d of the outlet is of advantage in particular when the auxiliary-grinding-body return conduits expand from the inside outwards in the direction of flow and, in addition, are convex as seen from the inside out-wards. The optimizable design of the auxiliary-grinding-body conduits also ensures safe discharge of the auxiliary grinding bodies from the inside outwards. The pressure gradient from the inside outwards that occurs in this case is such that any shooting flow of the grinding stock from the grinding-stock inlet in short-cut to the separator device is precluded. Optimal marginal conditions regarding the expansion of the auxiliary-grinding-stock return conduits from the inside outwards are specified by d>1.5 c applying to the width c of the inlet in relation to the width d of the outlet. With the design of the auxiliary-grinding-body return conduits inside the auxiliary-grinding-body return module offering the possibility of comparatively decreased height of the auxiliary-grinding-body return conduits in the direction of the central longitudinal axis, the risk of any shooting flow of the grinding-stock particles can be reduced without excellent separation of the auxiliary grinding bodies from the grinding stock being negatively affected.

Further improvements reside in the advantageous embodiments according to which the return module, in vicinity to the separator device, is provided with wipers which pass continuously without interruption into the return conduits; and according to which the wipers extend throughout the height f of the auxiliary-grinding-body separator device.

With the interior grinding chamber being followed by a discharge conduit in the shape of a truncated cone which is directed towards the grinding-stock/auxiliary-grinding-body separator device, an accumulation effect can be exercised on the auxiliary grinding bodies in the interior grinding chamber so that the dispersing and grinding intensity is increased. This effect can be achieved in particular by a further development according to which the discharge conduit is defined by a face, neighbouring the separator device, of the interior stator and by a dam-up device. A local increase of the auxiliary-grinding-body concentration in the top end area of the interior grinding chamber can be achieved by such a dam-up device, which again results in especially intensive grinding and dispersing and, consequently, in very fine grinding-stock particle size distribution. Being an independent component part, such a separately incorporated dam-up device can be adapted to any concrete application. In doing so, the gap width of the discharge conduit in the direction towards the separator device may be constant or grow.

Fundamentally it is of special advantage when the interior stator is provided with a wearing protection in the vicinity of the discharge conduit, which is particularly advantageous when the gap width of the discharge conduit does not grow towards the separator device i.e., radially inwards, and, consequently, when the cross section of flow is reduced, accompanied with corresponding acceleration of the grinding-stock/auxiliary-grinding-body flow.

In particular in combination with the wipers, an intermediate ring can advantageously be disposed between the dam-up device and the auxiliary-grinding-body module, it being possible in a simple way to adapt the intermediate ring to varying designs and in particular axial heights of the auxiliary-grinding-body return conduits.

Further features and advantages of the invention will become apparent from the ensuing description of exemplary embodiments, taken in conjunction with the drawing.

DESCRIPTION OF PREFERRED EMBODIMENTS

Figure 1:
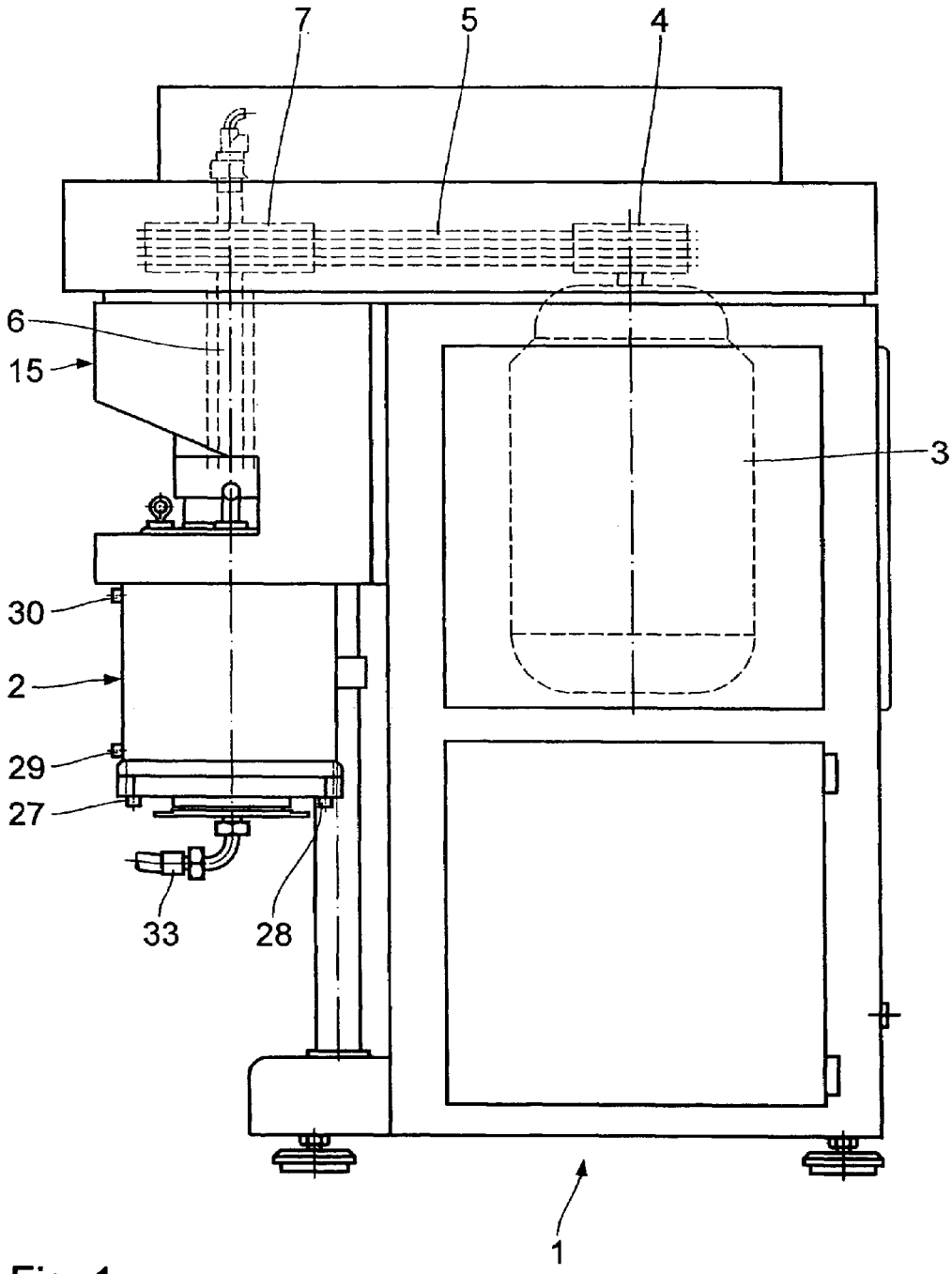
FIG. 1 is a diagrammatic illustration of a side view of an agitator mill.

The agitator mill seen in FIG. 1 conventionally comprises a stand 1 to which to attach a cylindrical grinding receptacle 2. An electric drive motor 3 is housed in the stand 1 and is provided with a V-belt pulley 4 by means of which a V-belt pulley 7, fixed against rotation on a shaft 6, is rotarily drivable.

Figure 2:
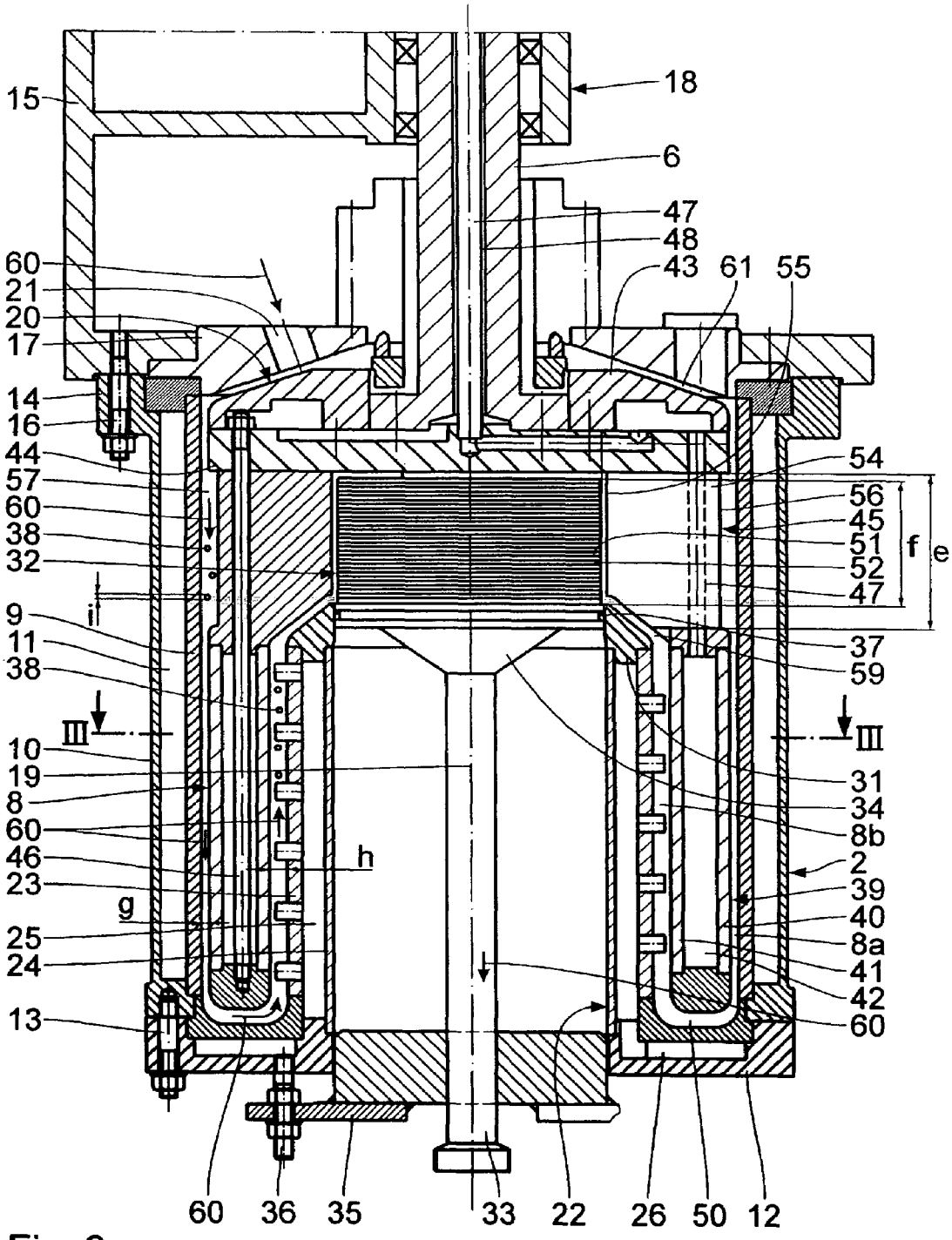
FIG. 2 is a longitudinal sectional view of a first embodiment of a grinding receptacle of the agitator mill.
Figure 3:
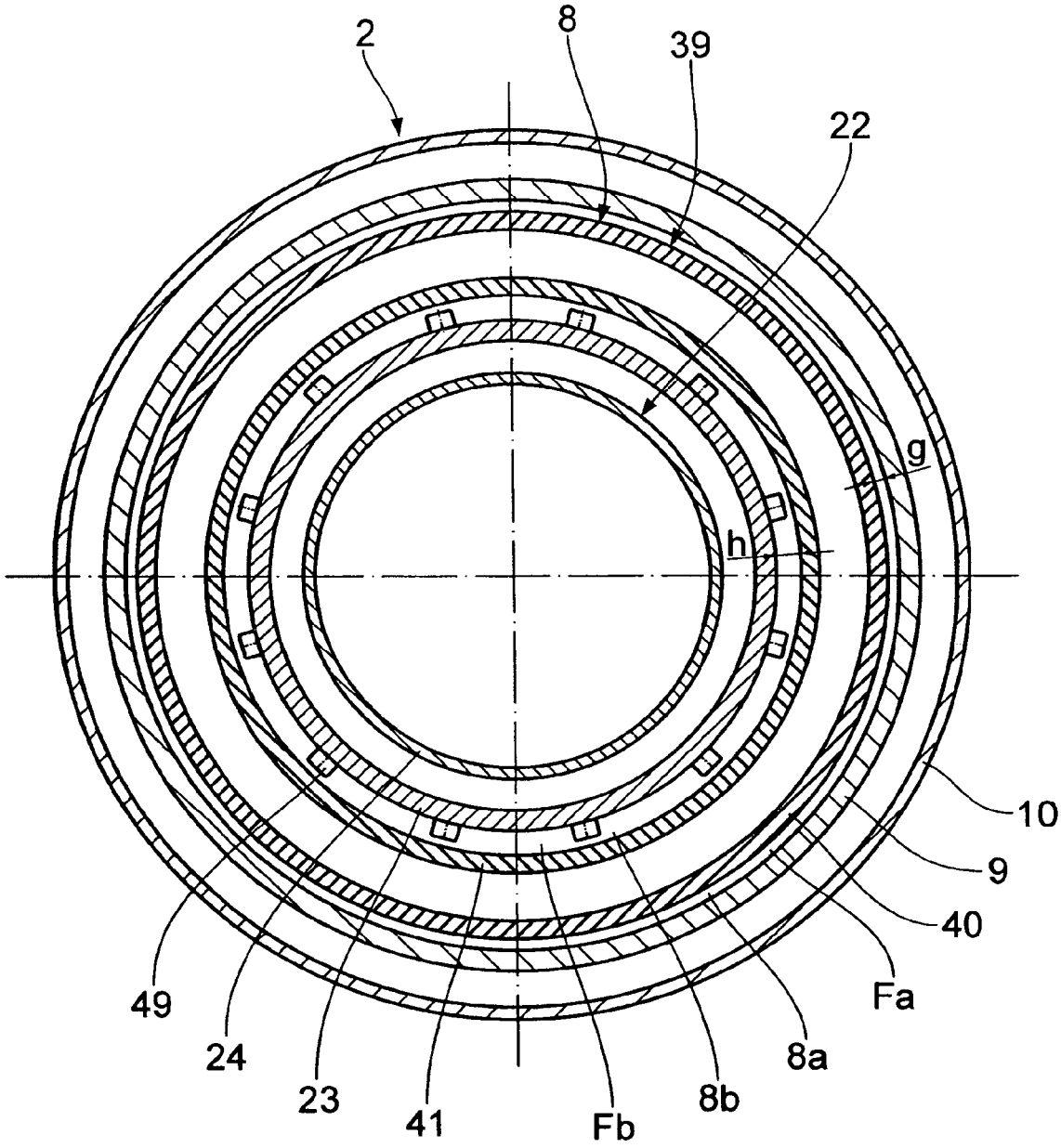
FIG. 3 is a cross-sectional view of the grinding receptacle on the line III—III of FIG. 2.

As shown in particular in FIGS. 2 and 3, the grinding receptacle 2 comprises a cylindrical inner wall 9 which surrounds a grinding chamber 8 and is surrounded by a substantially cylindrical outer casing 10. The inner wall 9 and the outer casing 10 define between each other a cooling chamber 11. The bottom closure of the grinding chamber 8 is formed by a circular bottom plate 12 which is fastened by means of screws 13 to the grinding receptacle 22.

The grinding receptacle 2 has an upper annular flange 14 by means of which is it fixed by screws 16 to the underside of a support housing 15 that is mounted on the stand 1 of the agitator mill. The grinding chamber 8 is closed by a lid 17. The support housing 15 has a central bearing and sealing housing 18 which is disposed coaxially with the central longitudinal axis 19 of the grinding receptacle 2. The bearing and sealing housing 18 is penetrated by the shaft 6 which also extends coaxially with the axis 19 and on which is provided an agitator 20. A grinding-stock supply line 21 opens into the area, adjacent to the grinding chamber 8, of the bearing and sealing housing 18.

An approximately cup-shaped cylindrical interior stator 22 is fixed to the circular bottom plate 12 and projects into the grinding chamber 8; it is comprised of a cylindrical outer casing 23 which is coaxial with the axis 19 and defines the grinding chamber 8; and of a cylindrical inner casing 24 which is also coaxial with the axis 19. Between themselves they define a cooling chamber 25. The cooling chamber 25 is connected with a cooling chamber 26 in the bottom 12, to which cooling water is supplied via a cooling-water supply connector 27 and discharged via a cooling-water discharge connector 28. Cooling water is supplied to the cooling chamber 11 of the grinding receptacle 2 via a cooling-water supply connector 29 and discharged via a cooling-water discharge connector 30.

Disposed on the upper annular face 31, located above the grinding chamber 8, of the interior stator 22 is a grinding-stock/auxiliary-grinding body separator device 32 which is connected with a grinding-stock discharge line 33. Between the separator device 32 and the discharge line 33 provision is made for a grinding-stock collection funnel 34. In the vicinity of the bottom plate 12, the discharge line 33 is provided with a handle 35 which, by means of screws 36, is detachably joined to the bottom plate 12 and, respectively, to the interior stator 22 that is fixedly connected thereto. The separator device 32 is sealed towards the annular face 31 of the interior stator 22 by means of a seal 37 and, together with the discharge line 33 and the collection funnel 34, can be pulled downwards out of the interior stator 22 once the screws 36 have been loosened. The separator device 32 can be removed from the grinding chamber 8 without the auxiliary grinding bodies 38 in the grinding chamber 8 having to be removed therefrom, because, with the agitator 20 not being driven, the level to which the grinding chamber 8 is filled with these auxiliary grinding bodies 38 does not extend to the face 31.

The basic structure of the agitator 20 is cup-shaped i.e., it has a substantially annular cylindrical rotor 39. The rotor 39 has a cylindrical outer wall 40 and a cylindrical inner wall 41 which is disposed coaxially there-with and coaxially with the axis 19. The outer wall 40 and the inner wall 41 are smooth, forming closed surfaces and consequently not exhibiting any interruptions. A cooling chamber 42 is formed between the outer wall 40 and the inner wall 41 of the rotor 39.

The top end of the agitator 20 is provided with a lid-type closing member 43, with a closing plate 44 being fixed to the underside thereof that is turned towards the rotor 39. The closing member 43 and the closing plate 44 are mounted on the shaft 6.

An auxiliary-grinding-body return module 45 is disposed between the rotor 39 and the closing plate 44 of the agitator 20. The rotor 39, the return module 45 and the closing plate 44 are detachably united by means of tie rods 46. The supply and discharge of cooling water to the cooling chamber 42 takes place via cooling-water conduits 47, 48 formed in the shaft 6 and in the return module 45.

An exterior grinding chamber 8*a* is formed by the smooth design of the inner wall 9 of the grinding receptacle 2, which does not possess any implements, and the equally smooth design of the outer wall 40 of the rotor 39. The smooth-walled design, also free of implements, of the inner wall 41 of the rotor 39 and the outer casing 23 of the interior stator 22 define an interior grinding chamber 8*b*. Elevations in the form of peg-style implements 49 that are mounted on the outer casing 23 of the interior stator 22 extend into this interior grinding chamber 8*b;* as seen in particular in FIG. 4, they are arranged helically along the circumference and length of the outer casing 23. As seen in particular in FIG. 4, implements 49 which adjoin in the peripheral direction of the interior stator 22 overlap in the direction of the central longitudinal axis 19 so that, upon rotation of the rotor 39, the inner wall 41 thereof will be wiped entirely by the implements 49.

As seen above, the grinding chamber 8 is divided into a cylindrical exterior grinding chamber 8*a* on the one hand and a cylindrical interior grinding chamber 8*b* on the other, these chambers being interconnected in vicinity to the bottom plate 12 by a deflection chamber 50 which expands steadily from the outside inwards.

Figure 4:
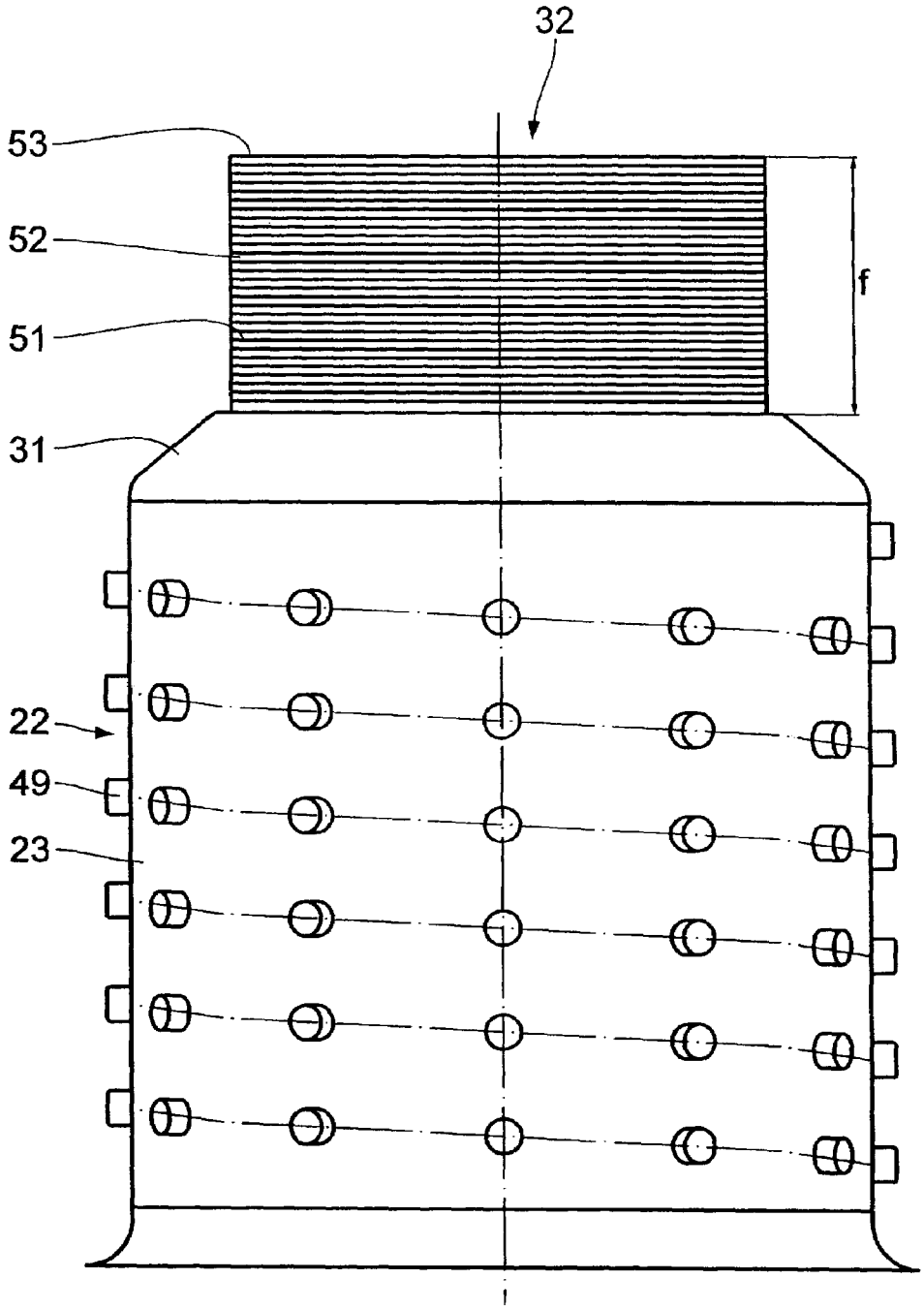
FIG. 4 is a longitudinal side view of an interior stator of the agitator mill.

As seen in FIGS. 2 and 4, the cylindrical separator device 32 is comprised of a stack of annular disks 51, between each of which a separating gap 52 has been left, the width of which is less than the diameter of the smallest auxiliary grinding bodies 38 used; however, the width may also exceed it, separation of the auxiliary grinding bodies 38 taking place before the separator device 32 has been reached. The stack of annular disks 51 is closed off frontally i.e., on the side turned towards the closing plate 44, by a closing plate 53. The separator device 32 is disposed within the return module 45.

Figure 5:
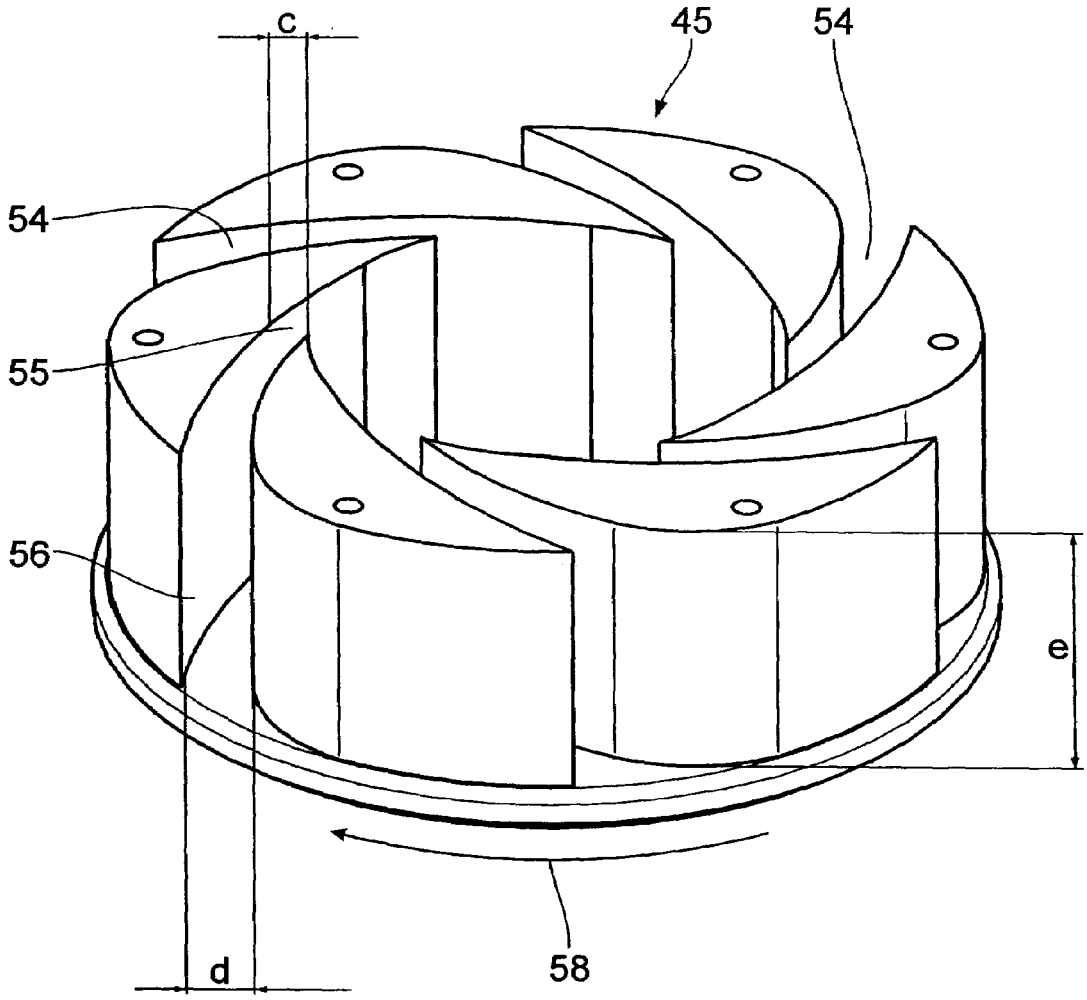
FIG. 5 is a perspective view of an auxiliary-grinding-body return module of the agitator mill according to FIGS. 2 to 4.

As seen in FIGS. 2 and 5, the auxiliary-grinding-body return module 45 is provided with auxiliary-grinding-body return conduits 54. Their respective inlet 55 directly adjoins the separator device 32. Their respective outlet 56 discharges into an annular cylindrical grinding-stock supply area 57 which is formed between the return module 45 and the inner wall 9 of the grinding receptacle 2. The return conduits 54 have their minimum width c at the inlet 55 and their maximum width d at the outlet 56, with the widths c and d being respectively measured in the peripheral direction. From the inlet 55 towards the outlet 56, the return conduits 54 are curved counter to the direction of rotation 58 of the agitator 20, namely convexly from the inside outwards. As for the width c in relation to the width d, $d>c$ applies, and preferably $d \geqq 1.5\ c$.

In the embodiment according to FIGS. 2 to 5, the return conduits 54 extend in the direction of the axis 19 nearly along the total height of the return module 45, their axial height e exceeding the axial height f of the separator device 32. In this embodiment, the return conduits 54, apart from extending across the separator device 32 in the direction of the axis 19, also reach across a discharge conduit 59 leading from the top end of the interior grinding chamber 8*b* obliquely upwards and inwards to the separator device 32 i.e., tapering in the shape of a truncated cone in the direction towards the closing plate 44. In this embodiment, the return conduits 54 are open also towards the discharge conduit 59 as seen in FIG. 2. Consequently, the discharge conduit 59 is not spatially defined upwards. Rather, it is open in the direction of the central longitudinal axis 19 towards the interior grinding chamber 8*b,* leaking auxiliary grinding bodies 38 while the grinding stock flows through the discharge conduit 59 in the direction towards the separator device 32.

The grinding stock flows through the grinding chamber 8 in accordance with the arrows of flow direction 60, passing from the grinding-stock supply line 21 through a grinding-stock supply chamber 61 between the closing member 43 of the agitator 20 on the one hand and the lid 17 and the adjacent area of the inner wall 9 on the other hand, through the grinding-stock supply area 57, through the exterior grinding chamber 8*a* downwards, radially inwards through the steadily expanding deflection chamber 50 and from there through the interior grinding chamber 8*b* upwards to the discharge conduit 59 and from there to the separator device 32. On its way through the exterior grinding chamber 8*a,* the deflection chamber 50 and the interior grinding chamber 8*b,* the grinding stock is being ground with the agitator 20 being rotarily driven in cooperation with the auxiliary grinding bodies 38. The grinding stock leaves the interior grinding chamber 8*b* via the separator device 32, from where it flows off through the grinding-stock discharge line 33.

As seen in particular from FIG. 2, the radial gap width g of the exterior grinding chamber 8*a* is distinctly less than the radial gap width h of the interior grinding chamber 8*b*. The relationship of the gap widths g and h to each other is such that the cross-sectional area Fb of the interior grinding chamber 8*b* equals or exceeds the cross-sectional area Fa of the exterior grinding chamber 8*a*. The exterior grinding chamber 8*a* as well as the interior grinding chamber 8*b* are designed as grinding gaps. As for the gap width g of the exterior grinding chamber 8*a* in relation to the diameter i of the biggest auxiliary grinding bodies 38 in the agitator mill, the following applies:

$$g \geqq 3i,$$

with i≦3.0 mm, and preferably i≦1.5 mm, applying to the diameter i.

As for the gap width g of the exterior grinding chamber 8*a*, g≦9.0 mm, and preferably g≦5.0 mm, applies absolutely.

As for the cross-sectional area Fa of the exterior grinding chamber 8*a* in relation to the cross-sectional area Fb of the interior grinding chamber 8*b*: Fa≦Fb applies, and preferably 1.2 Fa≦Fb≦7 Fa.

Figure 6:
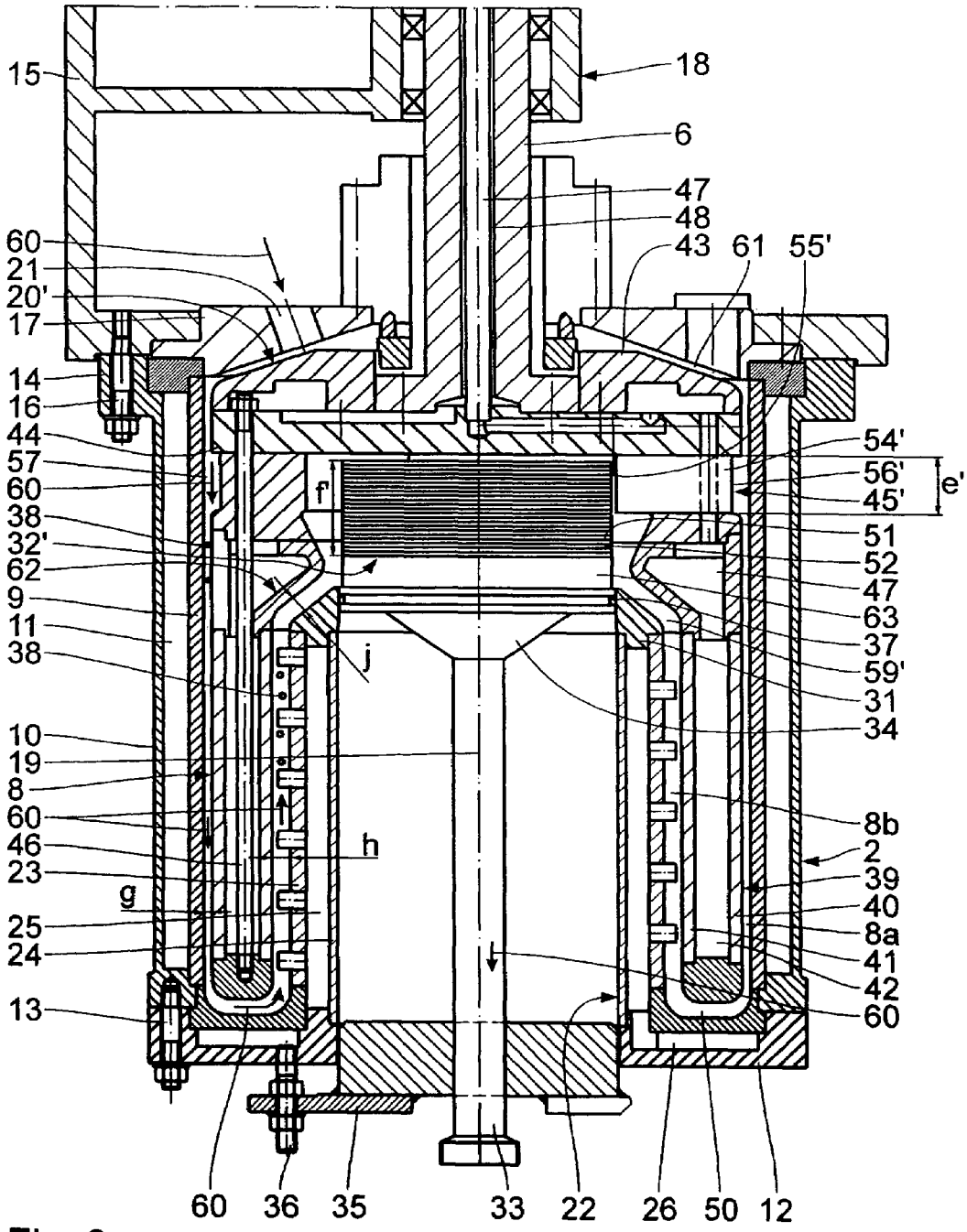
FIG. 6 is a longitudinal sectional view of a second embodiment of a grinding receptacle of the agitator mill.
Figure 7:
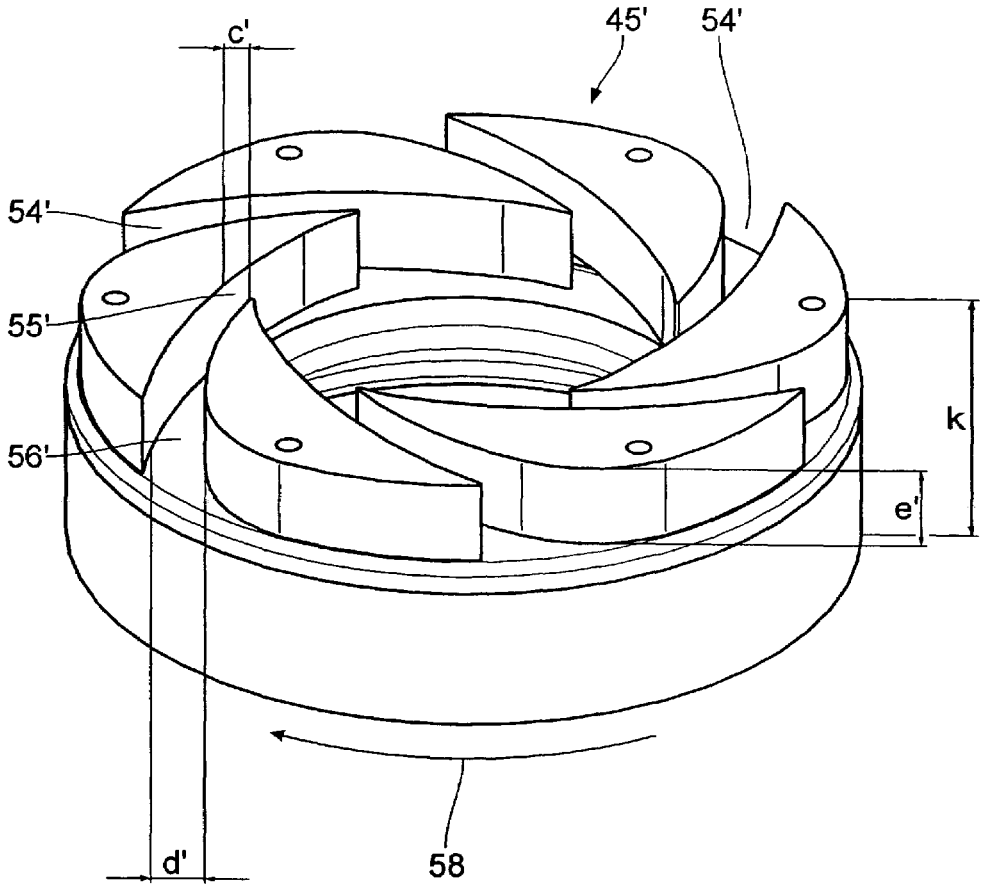
FIG. 7 is a perspective view of the auxiliary-grinding-body return module of the agitator according to FIG. 6.

The embodiment of FIGS. 6 and 7 differs from that of FIGS. 2 to 5 substantially in that, in addition to an auxiliary-grinding-body return module 45', a dam-up device 62 is provided as part of the agitator 20' between the closing plate 44 and the rotor 39. The discharge conduit 59' is defined between the face 31 of the interior stator 22 and this dam-up device 62 so that, by variation of the embodiment of FIGS. 2 to 5, it is defined not only at its underside by the face 31, but also at its top side by the dam-up device 62. Other than in the embodiment of FIGS. 2 to 5, the interior grinding chamber 8*b* does not discharge by its top end directly into the return conduits 54', but the mixture of grinding stock and auxiliary grinding bodies is forcibly deviated by the dam-up device 62 in a direction obliquely upwards and inwards towards the separator device 32'. The gap width j of the discharge conduit 59' is constant in this embodiment.

In as much as parts are identical with those of the embodiment according to FIGS. 2 to 5, the same reference numerals are used. Functionally identical and constructionally similar parts have the same reference numerals with a prime added. The same applies to further embodiments with a correspondingly higher number of primes. The height e' of the return conduits 54' is clearly inferior to the height e in the embodiment of FIGS. 2 to 5. Furthermore the height e' is clearly inferior to the axial height f' of the separator device 32'. This is a simple way of ensuring that the height e' of the return conduits 54' can be adapted to reduced grinding-stock throughputs and that the risk of grinding-stock-particle shooting flows can additionally be reduced, in particular in the case of little grinding-stock throughput or a low speed of the agitator 10. It applies:

e'≦f' and in particular e'≦0.8 f' and especially e'≦0.5 f'.

Furthermore, the separator device 32' does not extend across the entire area above the face 31. Rather, a closed annular section is provided as a wearing protection 63 between the face 31 and the separator device 32'; the wearing protection 63 and the separator device 32' are one piece. The discharge conduit 59' ends ahead of, or at, the wearing protection 63 so that any auxiliary grinding bodies 38, leaking from the discharge conduit 59' and being deflected into a motion parallel to the axis 19, do not hit the separator device 32'.

Figure 8:
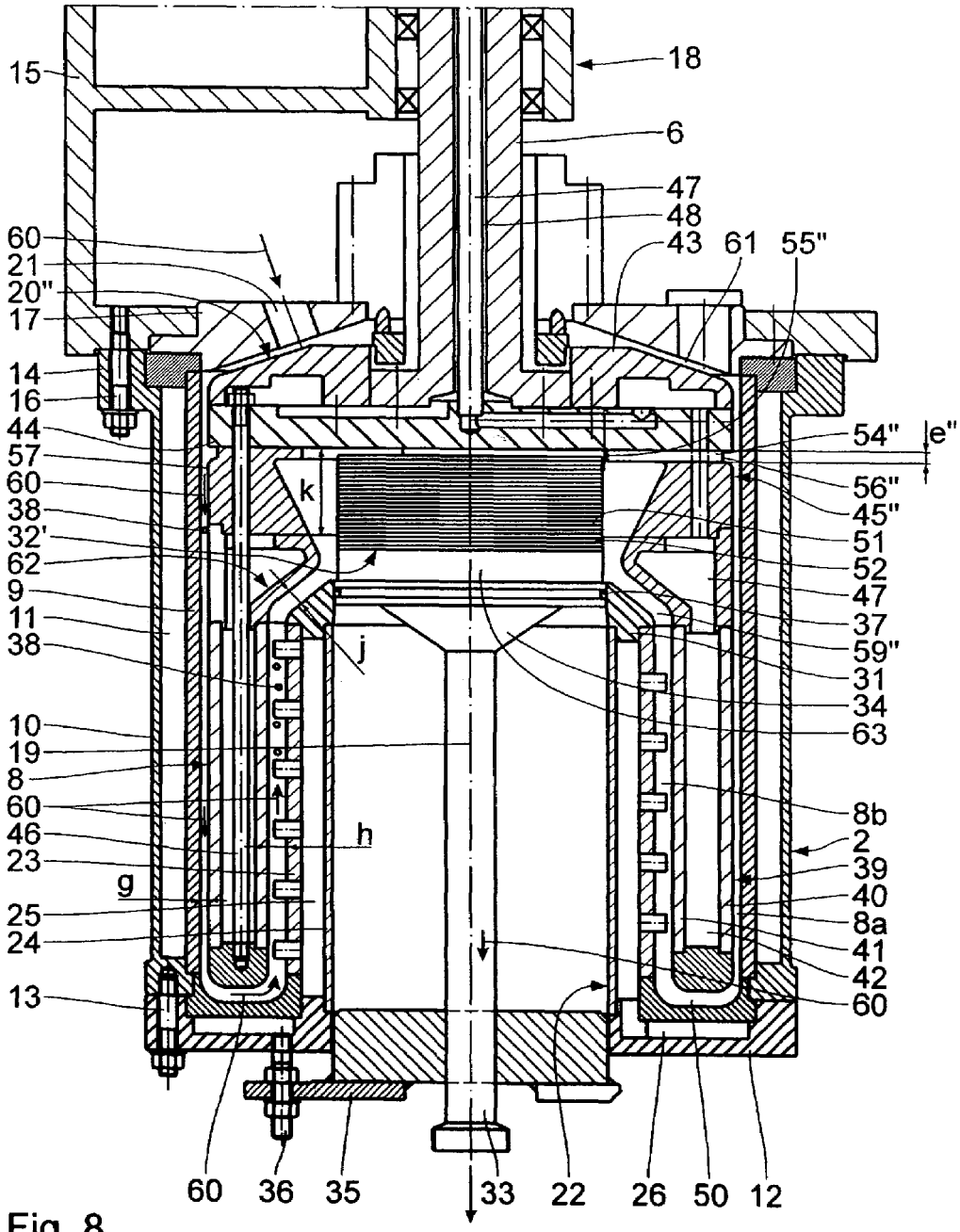
FIG. 8 is a longitudinal sectional view of a third embodiment of a grinding receptacle of the agitator mill.

The embodiment according to FIG. 8 differs from that of FIGS. 6 and 7 only in that the auxiliary-grinding-body return conduits 54" have a minimum height e" required for trouble-free operation at inferior grinding-stock throughputs. In this case too the auxiliary-grinding-body return module 45" adjoins the dam-up device 62, with the return conduits 54", at their top side, being defined by the closing plate 44 in this embodiment as well as in the two embodiments mentioned above. However the axial height k is the same in the return modules 45' and 45".

As for the minimal axial height e" of the return conduits 54" the following applies: e"≧3 i, and at least e"≧4 mm.

Figure 9:
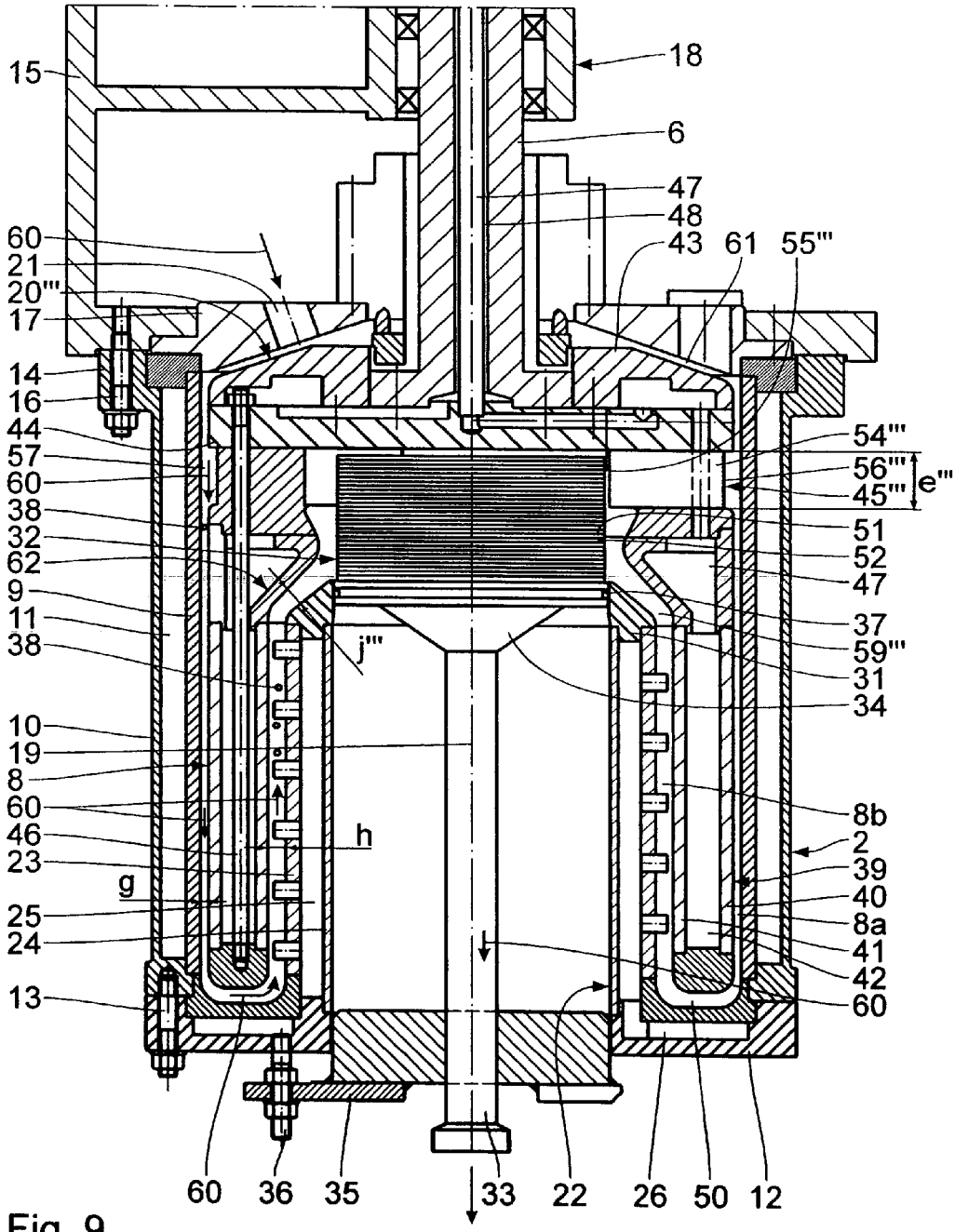
FIG. 9 is a longitudinal sectional view of a fourth embodiment of a grinding receptacle of the agitator mill.

The embodiment according to FIG. 9 corresponds to that of FIG. 6 with the difference residing in that no wearing protection 63 is provided and that the discharge conduits 59''' expand towards the auxiliary-grinding-body separator device 32 i.e., the gap width j'''. of the discharge conduit 59''' grows in-wards to such an extent that the total cross-sectional area of this conduit 59''' does not decrease in the direction towards the separator device 32 so that no acceleration of the flow of grinding stock and auxiliary grinding bodies takes place in the discharge conduit 59''' towards the separator device 32. For this reason, the separator device 32 can extend as far as to the face 31, because the auxiliary grinding bodies 38 do not hit the separator device 32.

Figure 10:
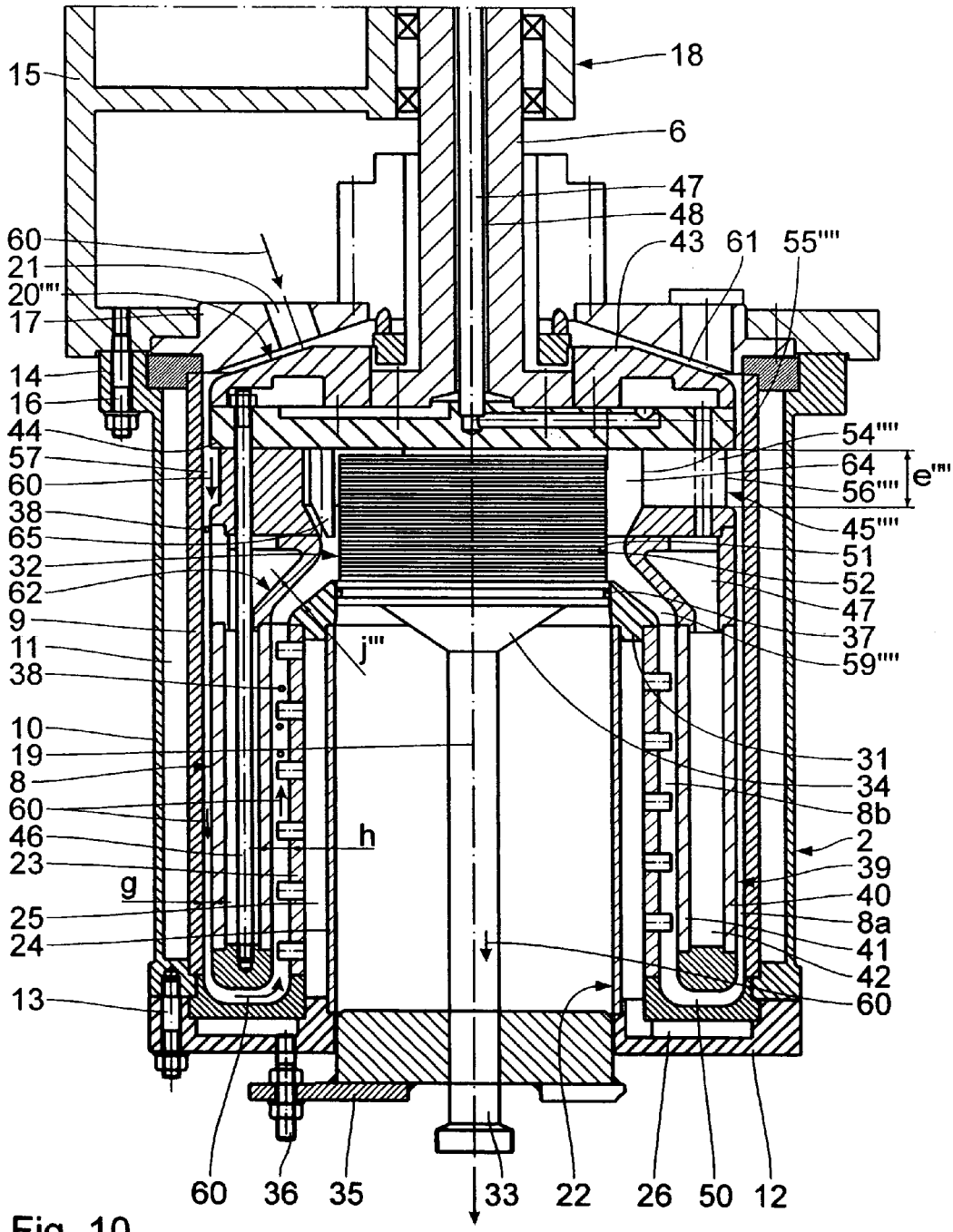
FIG. 10 is a longitudinal sectional view of a fifth embodiment of a grinding receptacle of the agitator mill.

The embodiment according to FIG. 10 substantially corresponds to that of FIG. 9, with the auxiliary-grinding-body return module 45'''' not leading as far as to the separator device 32. The inlets 55'''' of the auxiliary-grinding-body return conduits 54'''' have a clear radial distance from the separator device 32. In this annular chamber 64, provision is made for several wipers 65 which are mounted on the closing plate 44 and rotate together with the agitator 20''''.

Figure 11:
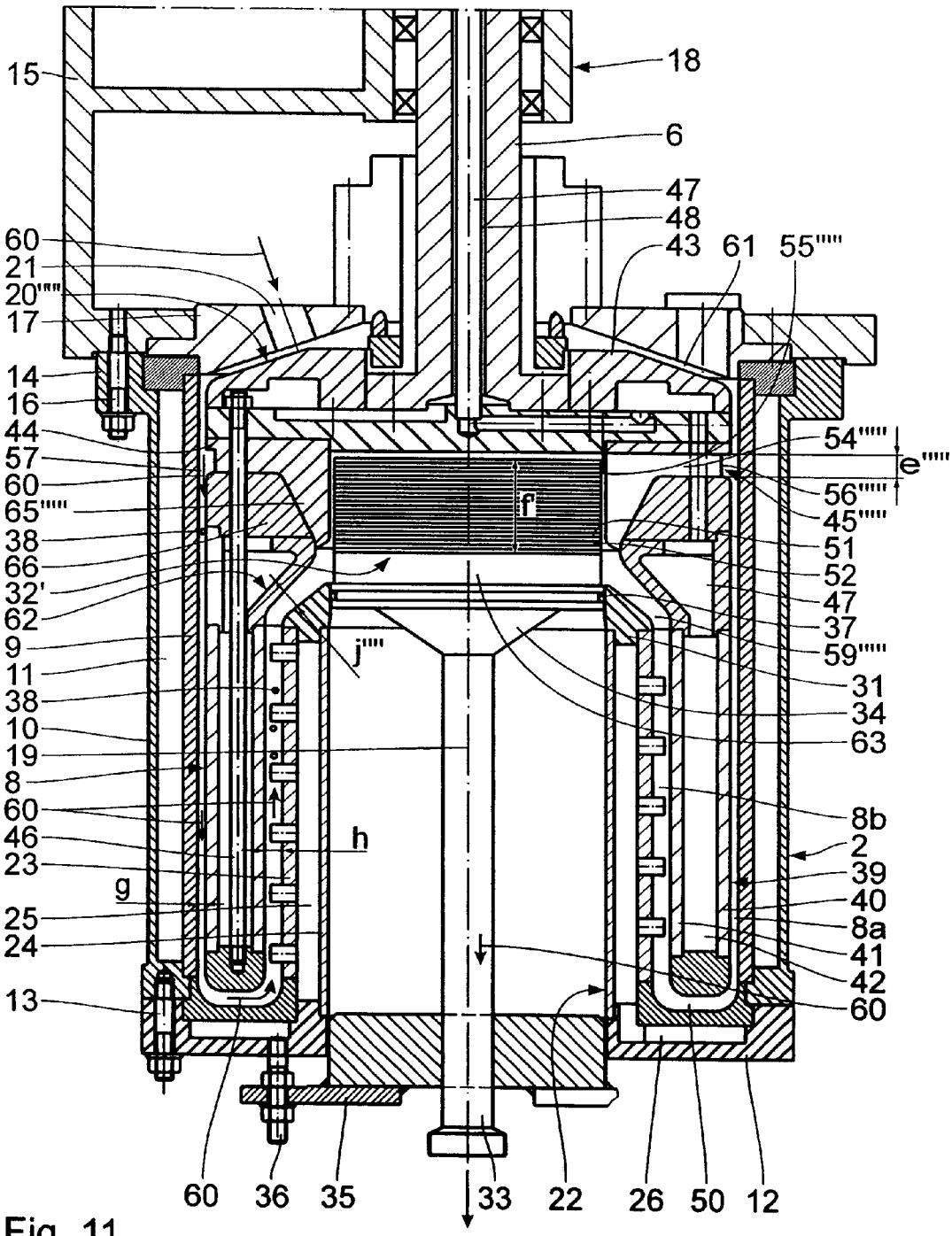
FIG. 11 is a longitudinal sectional view of a sixth embodiment of a grinding receptacle of the agitator mill.
Figure 12:
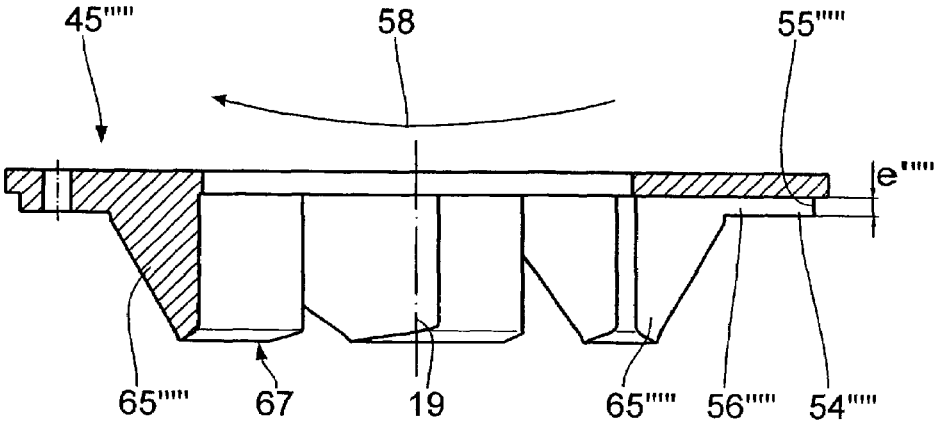
FIG. 12 is a side view of an auxiliary-grinding-body return module of the agitator mill according to FIG. 11.
Figure 13:
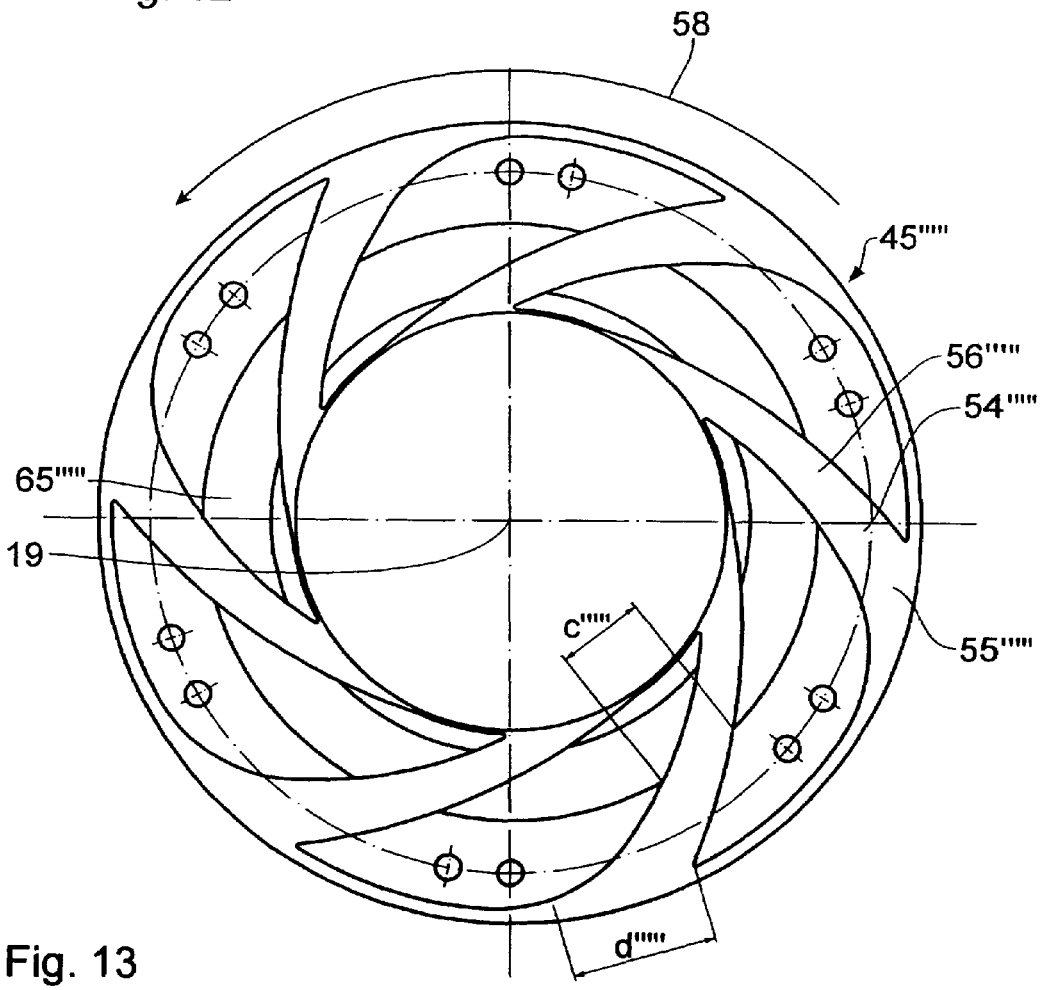
FIG. 13 is a view from below of the auxiliary-grinding-body return module according to FIG. 12.

The embodiment according to FIGS. 11 to 13 comprises an auxiliary-grinding-body return module 45''''' which, towards the dam-up device 62, bears against an intermediate ring 66. The module 45''''' is open downwards towards the grinding chamber 8 i.e., towards a front 67. The axial height e''''' is constant from the respective inlet 55''''' to the outlet 56''''' and distinctly less that the height f' of the separator device 32'. The wipers 65''''' directly adjoin the return conduits 54''''' so that there is a continuous transition from these wipers 65''''' into the return conduits 54''''', as shown in particular in FIG. 13. This leads to optimal flow conditions. As seen in FIG. 11, the wipers 65''''' extend in the direction of the axis 19 approximately along the height f' of the separator device 32'.

What is claimed is:

1. An agitator mill for treating free-flowing grinding stock, comprising a grinding receptacle (2) which defines a substantially closed grinding chamber (8) by means of an inner wall (9); and an agitator (20) which is rotarily drivably disposed therein and which is cup-shaped in relation to a common central longitudinal axis (19), having an annular cylindrical rotor (39) which has a closed wall (40, 41); and an interior stator (22) which is disposed within the rotor (39) and fixedly joined to the grinding receptacle (2);

wherein an annular cylindrical exterior grinding chamber (8*a*) is formed between the inner wall (9) of the grinding receptacle (2) and an outer wall (40) of the rotor (39); wherein an annular cylindrical interior grinding chamber (8*b*) is formed between an inner wall (41) of the rotor (39) and an outer casing (23) of the interior stator (22), the interior grinding chamber (8*b*) being arranged coaxially within the exterior grinding chamber (8*a*) and connected thereto via a deflection chamber (50);

wherein the exterior grinding chamber (8*a*), the deflection chamber (50) and the interior grinding chamber (8*b*)

constitute the grinding chamber (8) which is partially filled with auxiliary grinding bodies (38);

wherein a grinding-stock supply area (57), which is disposed upstream of the exterior grinding chamber (8*a*) and opens into it in the direction of flow (60) of the grinding stock, and a separator device (32), which is disposed downstream of the interior grinding chamber (8*b*) in the direction of flow (60), are disposed approximately on the same side of the grinding receptacle (2) for the grinding stock to pass through;

wherein auxiliary-grinding-body return conduits (54) are provided in the agitator (20) in an independent auxiliary-grinding-body return module (45), returning the auxiliary grinding bodies (38) from the vicinity of the separator device (32) into the grinding-stock supply area (57), the return conduits (54) connecting the end of the interior grinding chamber (8*b*) to the beginning of the exterior grinding chamber (8*a*);

wherein the inner wall (9) of the grinding receptacle (2) and the outer wall (40) and the inner wall (41) of the rotor (39) are free of interruptions;

wherein the auxiliary-grinding-body return conduits (54) are open towards a front (67) of the auxiliary-grinding-body return module (45); and wherein the auxiliary-grinding-body return conduits (54) have at least one of the following features:

the auxiliary-grinding-body return conduits (54) are curved from the inlet (55) towards the outlet (56);

the auxiliary-grinding-body return conduits (54) have a height (e) and the separator device (32) has a height (f), each in the direction of the central longitudinal axis (19), with $e \leqq 0.8$ f applying to the height (e) in relation to the height (f).

2. An agitator mill according to claim 1, wherein $e<0.5$ f applies to the height (e) of the auxiliary-grinding-body conduits (54) in relation to the height (f) of the separator device (32).

3. An agitator mill according to claim 1, wherein the auxiliary-grinding-body return conduits (54) have an inlet (55) of a width (c) and an outlet (56) of a width (d); and wherein $d>c$ applies to the width (c) of the inlet (55) in relation to the width (d) of the outlet (56).

4. An agitator mill according to claim 3, wherein $d>1.5$ c applies to the width (c) of the inlet (55) in relation to the width (d) of the outlet (56).

5. An agitator mill according to claim 1, wherein the return module (45), in vicinity to the separator device (32), is provided with wipers (65) which pass continuously without interruption into the return conduits (54).

6. An agitator mill according to claim 5, wherein the wipers (65) extend throughout the height (f) of the separator device (32).

7. An agitator mill according to claim 1, wherein the interior grinding chamber (8*b*) is followed by a discharge conduit (59) in the shape of a truncated cone which is directed towards the separator device (32).

8. An agitator mill according to claim 7, wherein the discharge conduit (59) is defined by a face (31), neighbouring the separator device (32), of the interior stator (22) and by a dam-up device (62).

9. An agitator mill according to claim 8, wherein the dam-up device (62) is an independent component part of the agitator (20).

10. An agitator mill according to claim 9, wherein an intermediate ring (66) is disposed between the auxiliary-grinding-body return module (45) and the dam-up device (62).

11. An agitator mill according to claim 7, wherein the gap width (j) of the discharge conduit (59) grows in a direction towards the separator device (32).

12. An agitator mill according to claim 7, wherein the interior stator (22) is provided with a wearing protection (63) in the vicinity of the discharge conduit (59).

* * * * *